US007213299B2

(12) United States Patent
Grande

(10) Patent No.: US 7,213,299 B2
(45) Date of Patent: May 8, 2007

(54) METHOD AND APPARATUS FOR SECURING A DOOR PISTON TO A DOOR JAMB

(75) Inventor: Carmen Grande, Rochester, NY (US)

(73) Assignee: Structural Protective Products, Inc., Ambridge, PA (US)

( * ) Notice: Subject to any disclaimer, the term of this patent is extended or adjusted under 35 U.S.C. 154(b) by 0 days.

(21) Appl. No.: 10/507,233

(22) PCT Filed: Mar. 11, 2003

(86) PCT No.: PCT/US03/07589

§ 371 (c)(1),
(2), (4) Date: Jun. 17, 2005

(87) PCT Pub. No.: WO03/078775

PCT Pub. Date: Sep. 25, 2003

(65) Prior Publication Data

US 2005/0241104 A1 Nov. 3, 2005

(51) Int. Cl.
*E05F 3/00* (2006.01)
*E05F 3/02* (2006.01)

(52) U.S. Cl. ..... 16/66; 16/387; 16/DIG. 40

(58) Field of Classification Search ..... 16/66, 16/387, 71, DIG. 40, 254, 72, 78–80, 49, 16/51, 52, 57, 58
See application file for complete search history.

(56) References Cited

U.S. PATENT DOCUMENTS 4,313,239 A * 2/1982 Tsuneki ..... 16/236
4,648,151 A * 3/1987 Whaley ..... 16/71
5,152,487 A * 10/1992 Defatte et al. ..... 248/225.11
5,515,649 A * 5/1996 Strab ..... 49/280
5,829,098 A * 11/1998 Alonso ..... 16/71
6,397,431 B1 * 6/2002 Alonso ..... 16/72
6,634,059 B2 * 10/2003 Seiferd ..... 16/71
2002/0109061 A1 * 8/2002 Hansson ..... 248/309.1
2005/0015931 A1 * 1/2005 Ferre et al. ..... 16/382

* cited by examiner

*Primary Examiner*—Brian E. Glessner
*Assistant Examiner*—Mark Williams
(74) *Attorney, Agent, or Firm*—The Webb Law Firm

(57) ABSTRACT

A door piston to door jamb interface (30) includes an elongated plate (32) having a number of threaded holes (34) therein and a bracket (50) including a base (52) and a transverse support member (54) affixed to the base (52). Base (52) includes a set of holes (60) configured in the same pattern as each subset (36, 38 or 40) of threaded holes (34) of plate (32) whereupon, when set of holes (60) and one subset (36, 38 or 40) of threaded holes (34) are aligned, threaded bolts (44) inserted therethrough can threadedly mate with threaded holes (34) of subset (36, 38 or 40) of threaded holes (34) thereby securing base (52) to plate (32). Bracket (50) also defines a pin receiving hole (58) that is spaced from base (52) and which is configured to receive a pin (80) therethrough for pivotally securing an end of a door piston (78) to support member (54).

12 Claims, 5 Drawing Sheets

METHOD AND APPARATUS FOR SECURING A DOOR PISTON TO A DOOR JAMB

BACKGROUND OF THE INVENTION

1. Field of the Invention

The present invention relates to coupling a door piston to a door jamb.

2. Description of Related Art

With reference to FIG. 1, heretofore, a hydraulic door piston 2 utilized to automatically close a door 4, such as a screen door, was coupled to a door jamb 6 via a bracket 8. Bracket 8 typically included a base 10 having a transverse support member 12 affixed to base 10. Base 10 includes a plurality of holes 14 configured to receive suitably sized wood screws 16 which can be inserted through holes 14 and screwed into door jamb 6 when base 10 is positioned thereagainst. Support member 12 includes a pair of aligned pin receiving holes 18 spaced from base 10.

A distal end of a connecting rod 20 of door piston 2 includes a pin receiving hole (not shown) defined therein. The distal end of connecting rod 20 is configured so that when it is received in a gap formed between the pair of pin receiving holes 18 of support member 12, the pair of pin receiving holes 18 and the hole at the end of connecting rod 20 can be aligned whereupon a pin 24 can be inserted therethrough. Alternatively, an end of a housing 26 of door piston 2 opposite connecting rod 20 can include a hole (not shown) therein whereupon, when this end of housing 26 is positioned in the gap between the pair of pin receiving holes 18, pin 24 can be inserted through the pair of pin receiving holes 18 and the hole at the end of housing 26.

The end of door piston 2 not coupled to support member 12 can be coupled to door 4 in a manner known in the art. When coupled between door 4 and door jamb 6, door piston 4 is operative in a manner known in the art to close door 4 in the absence of door 4 being subjected to an opening force greater than the closing force applied to door 4 by door piston 2.

It is well known that when subjected to a higher than normal opening force, door 4 can deploy door piston 2 to its fully extended position whereafter said opening force can cause bracket 8 to pull away from door jamb 6 thereby stripping the screw threads formed in door jamb 6 by wood screws 16 during installation of bracket S. This stripping weakens or opens the connection between bracket 8 and door jamb 6 thereby adversely affecting the ability of door piston 2 to close door 4. In addition, if bracket 8 is totally ripped off door jamb 6, it may be difficult to re-attach bracket 8 to the shattered material of door jamb 6.

It is, therefore, desirable to overcome the above problem and others by providing a door piston to door jamb interface apparatus that enables a greater opening force to be applied by a door piston to a door jamb without damaging the door jamb. It is also desirable to provide a method of securing a door piston to a door jamb in a manner that enables greater opening forces to be applied by the door piston to the door jamb than bracket 8 permits. Still other desirable features of the present invention will become apparent to those of ordinary skill in the art upon reading and understanding the following detailed description.

SUMMARY OF THE INVENTION

The invention is a door piston to door jamb interface apparatus that includes an elongated plate having a plurality of threaded holes therein and a bracket including a base and a transverse support member affixed to the base. The base includes a set of holes configured in the same pattern as a subset of the plurality of threaded holes of the plate whereupon, when the set of holes and the subset of threaded holes are aligned, a threaded bolt can pass through each of the set of holes and threadedly mate with one of the subset of threaded holes thereby securing the base to the plate. The support member defines a pin receiving hole spaced from the base that is configured to receive a pivot pin therethrough for pivotally securing a connecting rod or a housing of a door piston to the support member.

The subset of threaded holes can be positioned adjacent an end of the plate or intermediate the ends of the plate.

Each threaded hole is also configured to pass a thread wood screw therethrough in a non-threading relationship. When the plate is positioned against the door jamb, at least one threaded hole can have a wood screw passed in non-threading relationship therethrough whereafter said wood screw can be screwed into the door jamb thereby securing the plate to the door jamb.

The support member can define a gap having a pair of aligned pin receiving holes on opposite sides thereof. The end of the connecting rod or the housing defines a hole configured to be aligned with the pin receiving holes when said end is received in the gap. The pin is configured to be received through the pin receiving holes and the hole in the end of the connecting rod or the housing when said end is received in the gap.

The plate can have a rectangular shape. However, this is not to be construed as limiting the invention.

The plurality of threaded holes can include three subsets thereof having the same pattern as the pattern of the set of holes of the base. Each threaded bolt can include a machine screw thread.

The invention is also a method of securing a door piston to a door jamb that comprises the steps of: (a) providing an elongated plate having a plurality of threaded holes formed therein; (b) positioning the plate against a door jamb with the longitudinal axis of the plate positioned generally parallel with a longitudinal axis of the door jamb; (c) inserting wood screws through a first subset of the threaded holes; (d) screwing the wood screws inserted in the first subset of threaded holes into the door jamb thereby securing the plate to the door jamb; (e) providing a bracket including a support member affixed to a base that defines a set of holes having the same pattern as a second subset of the plurality of threaded holes, with the support member defining therein a pin receiving hole that is spaced from the plate; (f) positioning the base of the bracket against the plate with the set of holes of the base aligned with the second subset of threaded holes; (g) inserting threaded bolts through the set of holes defined in the base of the bracket; and (h) rotating the threaded bolts inserted through the set of holes defined in the base whereupon threads of the threaded bolts threadedly engage the threads of the second subset of the plurality of threaded holes thereby securing the base to the plate.

The method can also include the steps of (i) aligning a hole at an end of a connecting rod or housing of a door piston with the hole in the support member of the bracket; and U) inserting a pin through the hole at an end of a connecting rod or housing and the hole in the support member whereupon the connecting rod or housing is pivotally coupled to the support member.

The second subset of threaded holes can be positioned at an end of the plate or intermediate at the ends of the plate. The first and second subsets of threaded holes can have the same pattern as the set of holes of the base. Moreover, the plate can include a third subset of threaded holes having the same pattern as the set of holes of the base.

The invention is also a door piston to door jamb interface apparatus comprising an elongated plate defining at least two sets of threaded holes configured in the same pattern and a support member configured to be affixed transverse to the plate via a set of threaded bolts threadedly mated with one of the set of threaded holes. The elongated plate is configured to be affixed to a door jamb via a set of screws which are screwed into the door jamb after insertion in non-threading relation through the other of the set of threaded holes. The support member defines a pin receiving hole that is spaced from the plate when the support member is affixed thereto. The pin receiving hole is configured to receive a pin therethrough for pivotally securing one end of a door piston to the support member.

The plate can include two sets of threaded holes adjacent the ends of the plate and a third set of threaded holes intermediate the ends of the plate.

The support member can define a gap having a pair of aligned pin receiving holes on opposite sides thereof. One end of the door piston can define a hole configured to be aligned with the pair of pin receiving holes when said end is received in the gap. The pin is configured to be received through the pin receiving holes and the hole in the end of the door piston when said end is received in the gap.

The apparatus can include a base having the support member affixed thereto. The base can define a set of holes having the same pattern as each set of threaded holes of the plate. The set of bolts can threadedly mate with one of the set of threaded holes after insertion through the set of holes defined by the base.

Lastly, the invention is a door piston a door jamb interface kit, comprising a set of threaded bolts, a set of threaded screws, an elongated plate having a plurality of threaded holes formed therein, and a bracket including a base and a transverse support member affixed to the base. A base includes a set of holes configured in the same pattern as a subset of the plurality of threaded holes of the plate. When the set of holes and the subset of threaded holes are aligned, one of the threaded bolts inserted through each of the set of holes can threadedly mate with one of the subset of threaded holes thereby securing the base to the plate. When the elongated plate is positioned against a door jamb, a threaded screw inserted in non-threading relation through each of the set of holes not receiving a threaded bolt can threadedly mate with said door jamb thereby securing said plate to said door jamb.

DETAILED DESCRIPTION OF THE INVENTION

The present invention will be described with reference to the accompanying figures where like reference numbers correspond to like elements.

Figure 1:
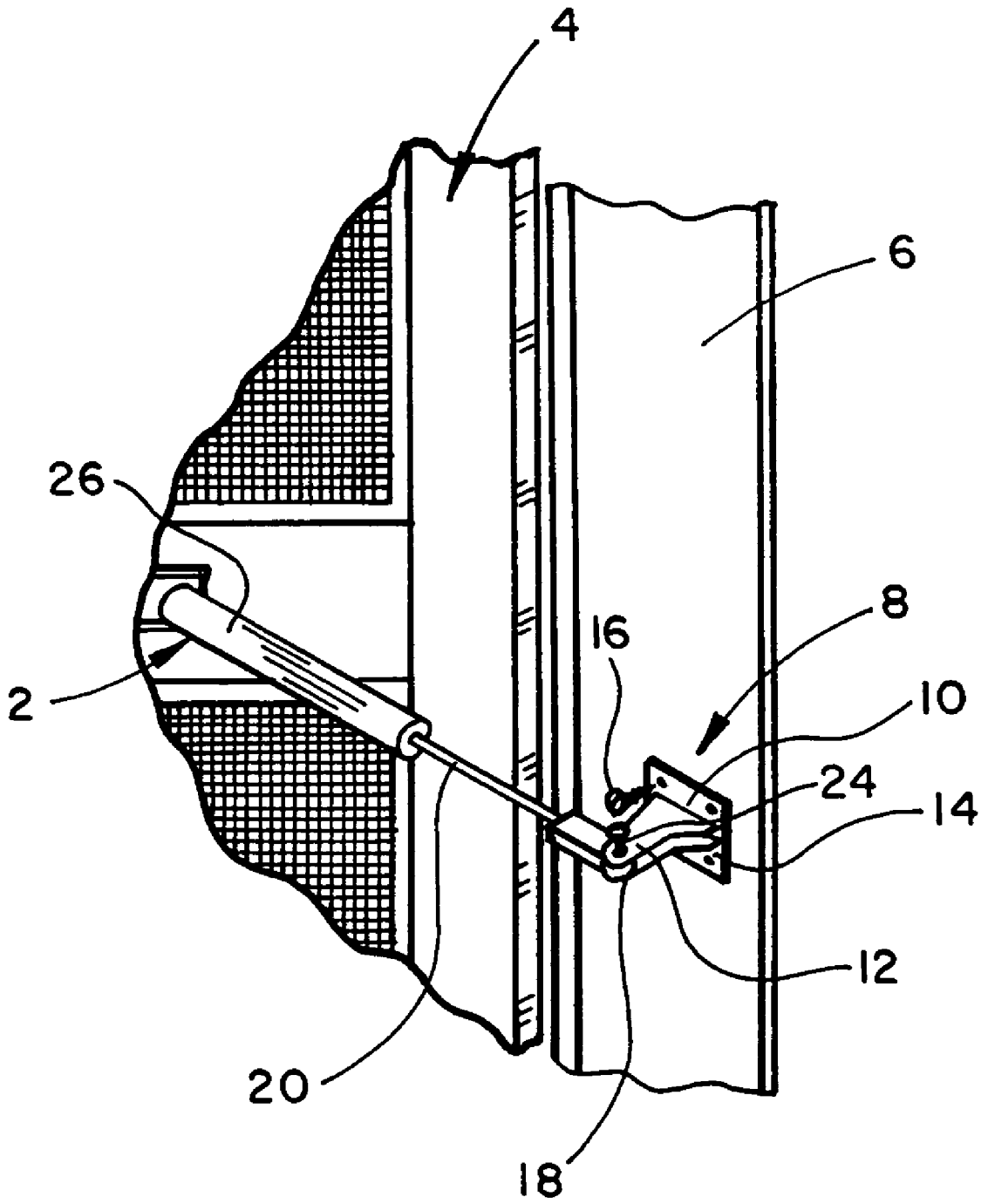
FIG. 1 PRIOR ART
FIG. 1 is a perspective view of a door having a door piston coupled to a door jamb via a bracket in accordance with the prior art.
Figure 2:
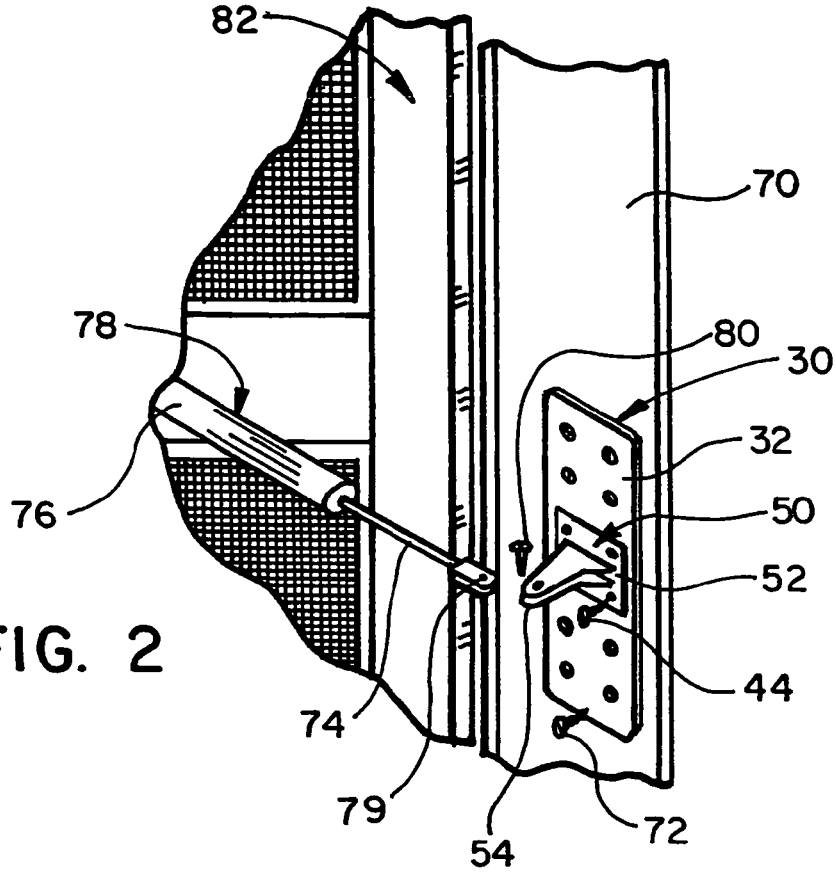
FIG. 2 is a perspective view of a door having a door piston coupled to a door jamb via a combination plate and bracket in accordance with the present invention.
Figure 3B:
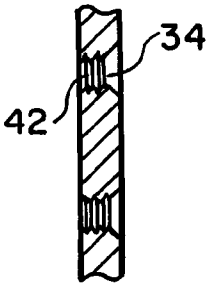
FIG. 3*b* is a cross-sectional view taken along lines IIIb—IIIb in FIG. 3*a;*
Figure 3A:
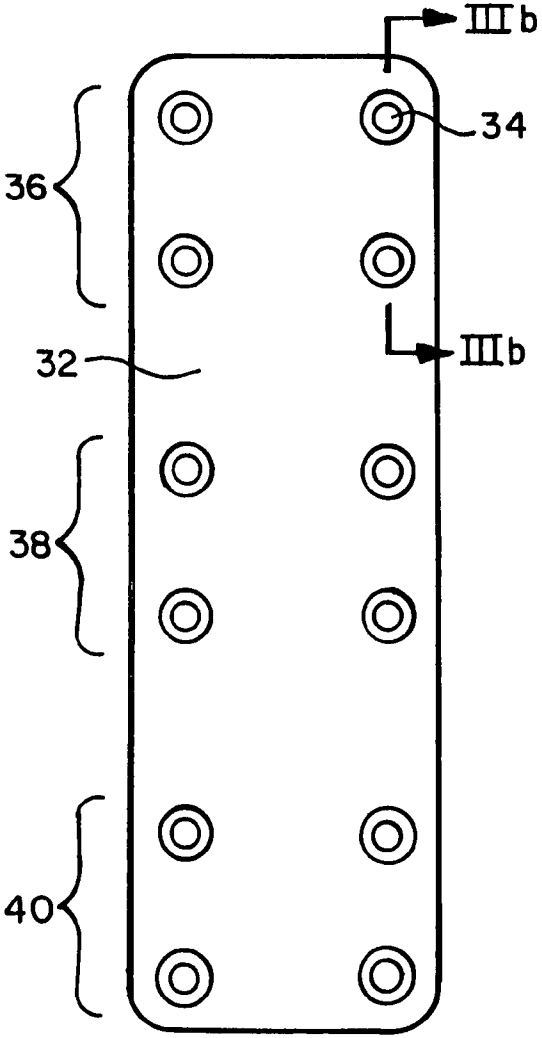
FIG. 3*a* is a front view of the plate shown in FIG. 2.

With reference to FIGS. 2, 3*a* and 3*b*, a door piston to door jamb interface apparatus 30 includes a flat, elongated plate 32 having a plurality of threaded holes 34 formed therein. The plurality of threaded holes 34 includes a first subset 36 of four threaded holes 34, a second subset 38 of four threaded holes 34 and a third subset 40 of four threaded holes 34, with each subset 36, 38 and 40 having the same pattern, e.g., a rectangular pattern. The pattern and the number of threaded holes of each subset 36, 38 and 40, however, are not to be construed as limiting the invention.

Each threaded hole 34 includes screw threads 42 configured to threadedly mate with screw threads (not shown) of a threaded bolt 44 when said bolt 44 is screwed into threaded hole 34.

Figure 4A:
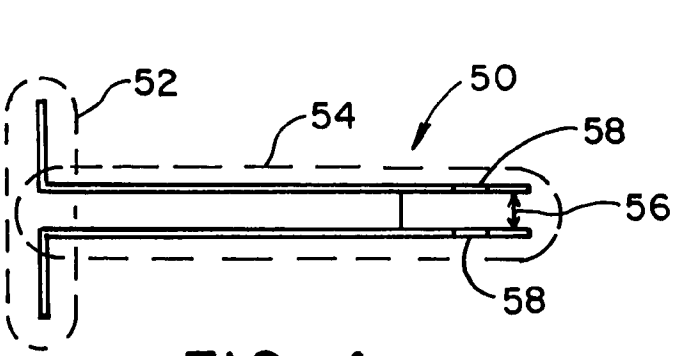
FIGS. 4*a*–4*c* are top, front and side of views of the bracket shown in FIG. 2.
Figure 4C:
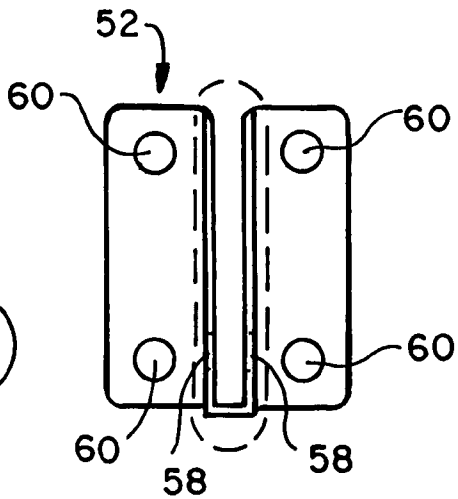
Figure 4B:
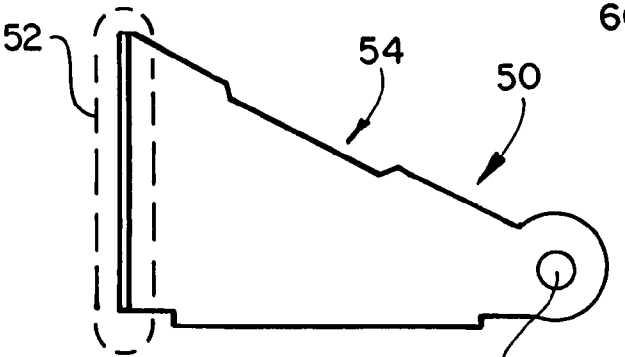

With reference to FIGS. 4*a*–4*c*, and with continuing reference to FIGS. 2, 3*a* and 3*b*, apparatus 30 also includes a bracket 50 having a base 52 and a transverse support member 54 affixed to base 52. Support member 54 defines a gap 56 having a pair of aligned pin receiving holes 58 on opposite sides thereof.

Base 52 includes a plurality of holes 60 through which threaded bolts 44 can be inserted. The pattern of holes 60 is configured to match the pattern of threaded holes 34 of each subset 36, 38 and 40 of threaded holes 34 defined by plate 32. Thus, in the illustrated embodiment, the plurality of holes 60 and each subset 36, 38 and 40 of threaded holes 34 have the same rectangular pattern. However, this is not to be construed as limiting the invention.

Figure 5:
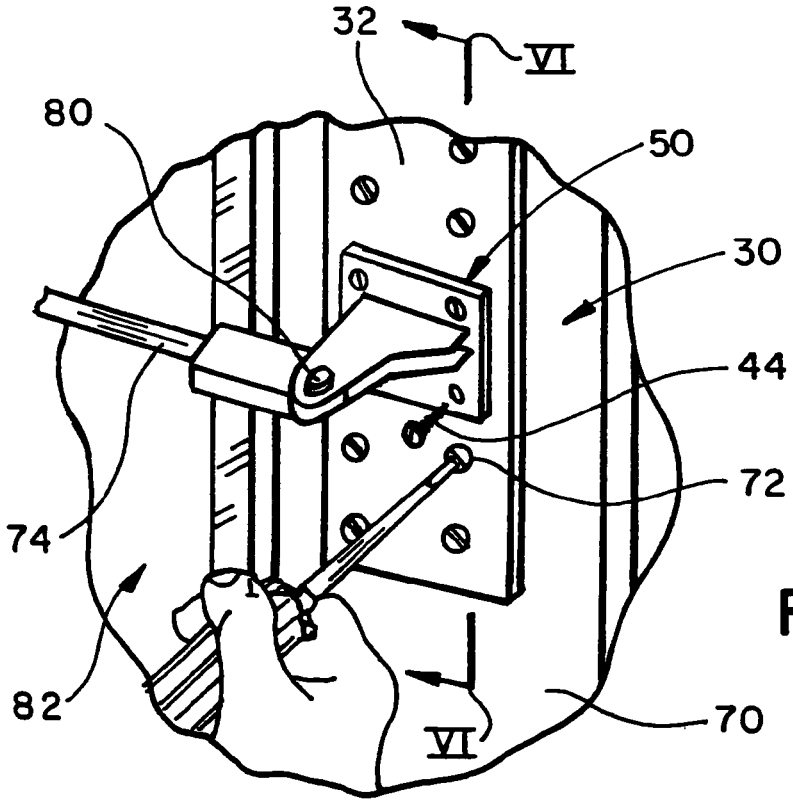
FIG. 5 is a close-up perspective view of the plate and bracket shown in FIG. 2 including the end of the connecting rod of the door piston pivotally coupled to the bracket.
Figure 6:
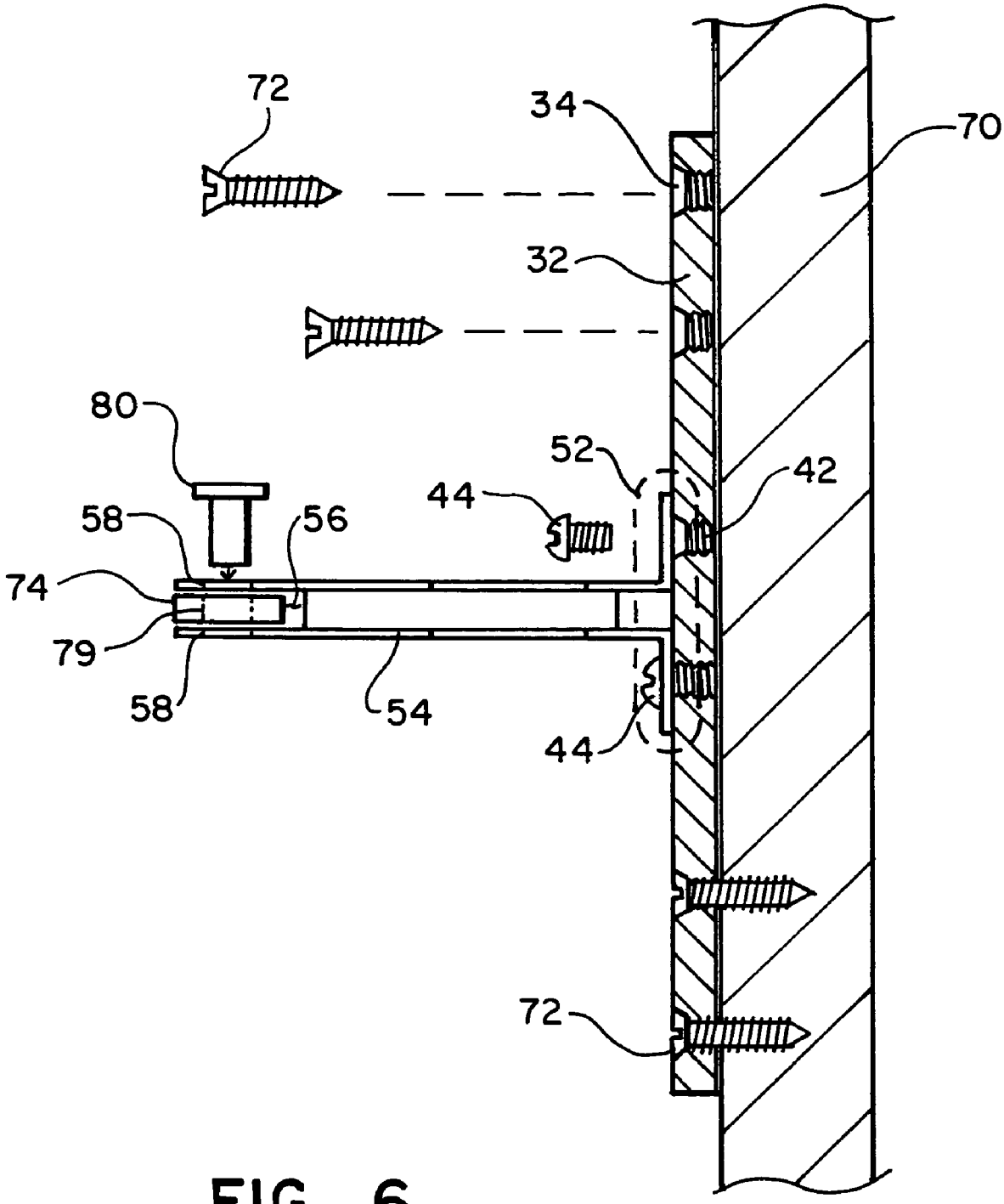
FIG. 6 is a section of the plate and door jamb taken along lines VI—VI in FIG. 5 having the bracket coupled thereto.

As shown in FIGS. 5 and 6, by positioning base 52 on plate 32 with the plurality of holes 60 aligned with threaded holes 34 of one of the subsets 36, 38 or 40 thereof, bracket 50 can be secured to plate 32 by simply inserting threaded bolts 44 through holes 60 and rotating the threaded bolts 44 whereupon the threads thereof threadedly engage threads 42 of said subset 36, 38 or 40 of threaded holes 34. Desirably, when threaded bolts 44 are fully seated in threaded holes 34 of one of said subsets 36, 38 or 40 thereby securing base 52 to plate 32, the threaded ends of threaded bolts 44 do not extend outside of threaded holes 34. However, this is not to be construed as limiting invention. The pattern of holes 60 and the pattern of threaded holes 34 of each subset 36, 38 and 40 thereof can be configured so that base 52 can be secured to plate 32 in a plurality of different orientations.

Figure 7:
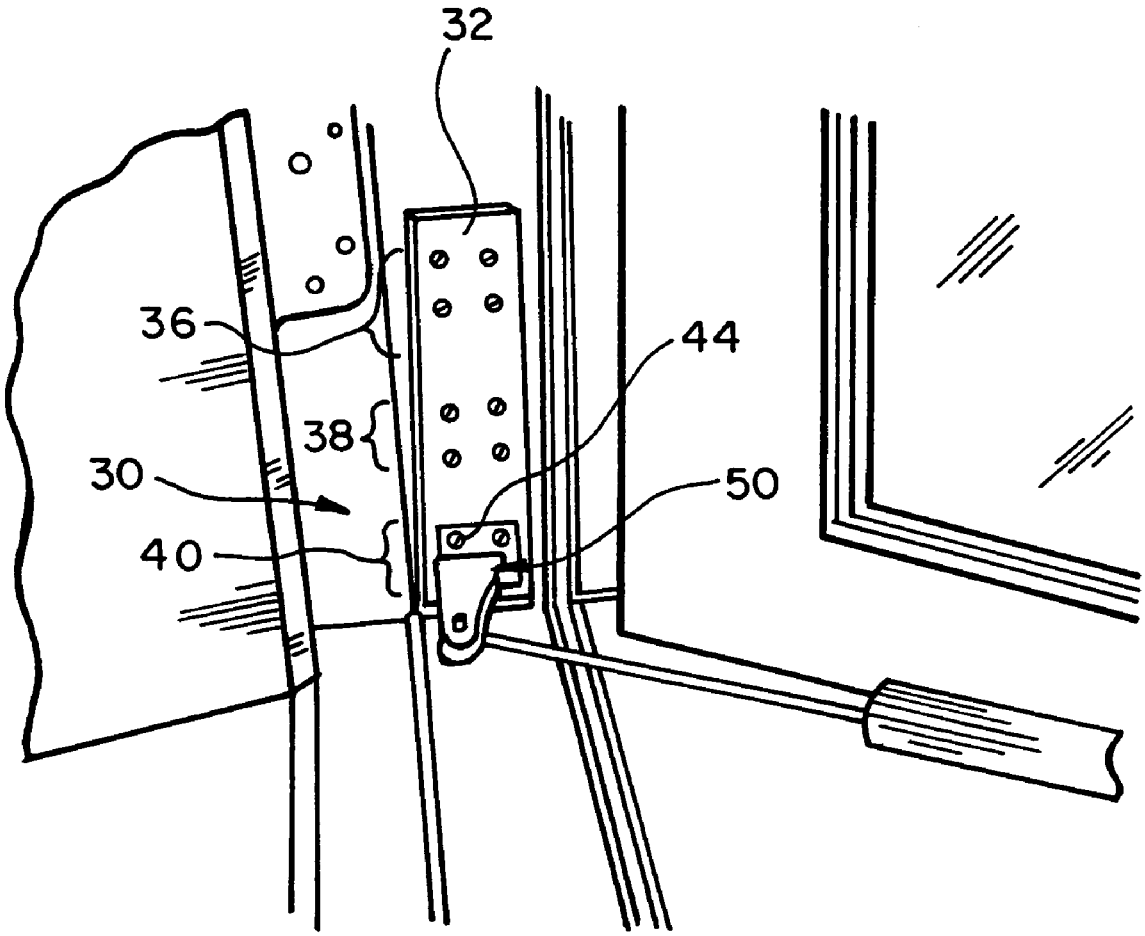
FIG. 7 is a perspective view of a door having a door piston coupled to the bottom of a door jamb via a combination plate and bracket in accordance with the present invention.

In FIGS. 2, 5 and 6, bracket 50 is illustrated as being secured to plate 32 via second subset 38 of threaded holes 34. However, this is not to be construed as limiting the invention since bracket 50 can be secured to plate 32 via the first subset 36 of threaded holes 34 or the third subset 40 of threaded holes 34 as desired or required by the application. For example, as shown in FIG. 7, if apparatus 30 is utilized with a door having a door piston adjacent a bottom end thereof, bracket 50 call be connected to plate 32 via subset 40 of threaded holes 34 closest adjacent a bottom of the door jamb. Similarly, if apparatus 30 is utilized with a door having a door piston adjacent a top end thereof, bracket 50 can be connected to plate 32 via subset 36 of threaded holes closest adjacent a top of the door jamb.

Before or after bracket 50 is secured to plate 32, plate 32 can be positioned against a door jamb 70 with the longitudinal axis of plate 32 positioned generally parallel with a longitudinal axis of door jamb 70. Thereafter, wood screws 72 can be inserted in non-threading relation through one or more threaded holes 34 not utilized for securing bracket 50 to plate 32. Wood screws 72 inserted in threaded holes 34 can be screwed into door jamb 70 to secure plate 32 to door jamb 70.

Once plate 32 having bracket 50 affixed thereto is secured to door jamb 70, an end of a connecting rod 74 or a housing 76 of a door piston 78 can be pivotally secured to support member 54. More specifically, the end of connecting rod 74 or housing 76 defines a hole 79 configured to be aligned with the pair of pin receiving holes 58 of support member 54 when said end is received in gap 56. A pin 80 can then be inserted through the pair of pin receiving holes and the hole in the end of connecting rod 74 or housing 76. Pin 80 enables the end of connecting rod 74 or the end of housing 76 coupled to bracket 50 to pivot with respect thereto. The end of the other of connecting rod 74 or housing 76 can be pivotally coupled to a door 82 in a manner known in the art. The pivotal connections of opposite ends of door piston 78 to bracket 50 and door 82 enable door piston 78 to apply to door 82 a closing force that closes door 82 or maintains door 82 closed.

As can be seen, apparatus 30 provides a robust interface between door piston 78 and door jamb 70 that overcomes the deficiencies of prior art brackets utilized to couple door jambs and door pistons. To this end, apparatus 30 protects a door jamb from being split and destroyed by the forceful removal of a prior art bracket therefrom absent the wood screws being removed from the door jamb. It can also be used to cover damage caused by the prior forceful removal of a prior art bracket while providing additional support to avoid subsequent forceful removal of bracket 50 and plate 32 from the door jamb absent the wood screws being removed from the door jamb.

In one exemplary embodiment, plate 32 is 3/16" thick, 1¾" wide and 5½" Threaded holes 34 are configured to accommodate 10–32 machine thread screws, i.e., threaded bolts 44, and #6 wood screws.

As can be seen, the present invention provides a door piston to door jamb interface apparatus that enables a greater opening force to be applied by the door piston to the door jamb and prevents damage to the door frame or to the door jamb. The present invention also provides a method of securing a door piston to a door jamb frame in a manner that enables greater opening forces to be applied by the door piston to the door jamb than prior art brackets and prevents damage to door frames by preventing the door bracket from being pulled from the door frame. The invention does so by reinforcing the area where the door bracket attaches to the door jamb, preventing splitting and cracking. The present invention replaces old hardware and extends the life of door frames that were damaged from door brackets previously ripped off. Thus, the present invention not only can be used to prevent damage to new doors, but can also reinforce old doors.

The invention has been described with reference to the preferred embodiments. Obvious modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A door piston to door jamb interface apparatus comprising:

a flat, elongated plate having a plurality of threaded holes formed therein, and arranged in at least a first subset of threaded holes and a second subset of threaded holes, with each subset of threaded holes having the same hole pattern; and a bracket including a base and transverse support member affixed to the base, the base including a set of holes configured in the same pattern as each of the first and second subset of the plurality of threaded holes of the plate whereupon, when the set of holes in the base of the bracket and the first or second subset of threaded holes in the plate are aligned, a threaded bolt inserted through each of the set of holes can threadedly mate with either the first or second subset of threaded holes thereby securing the base to the plate, wherein the support member defines a pin receiving hole that is spaced from the base and which is configured to receive a pin therethrough for pivotally securing a connecting rod or a housing of a door piston to the support member, wherein threaded ends of the threaded bolts do not extend outside of the threaded holes when the bracket is secured to the plate, wherein the threaded holes not used to attach the bracket to the plate can be used to attach the plate to a door jamb, wherein the support member defines a gap having a pair of aligned pin receiving holes on opposite sides thereof, wherein the end of the connecting rod or the housing defines a hole configured to be aligned with the pair of pin receiving holes when said end is received in the gap, and wherein the pin is configured to be received through the pin receiving holes and the hole in the end of the connecting rod or the housing when said end is received in the gap.

2. The apparatus of claim 1, wherein the first or second subset of threaded holes is positioned at least one of (i) adjacent an end of the plate and (ii) intermediate the ends of the plate.

3. The apparatus of claim 1, wherein:

each threaded hole is also configured to pass a threaded wood screw therethrough in non-threading relationship therewith; and when the plate is positioned against a door jamb, at least one threaded hole can have a wood screw passed in non-threading relationship therethrough whereafter said wood screw can be screwed into the doorjamb thereby securing the plate to the doorjamb.

4. The apparatus of claim 1, wherein the plate has a rectangular shape.

5. The apparatus of claim 1, wherein the plurality of threaded holes includes three subsets thereof having the same pattern as the pattern of the set of holes of the base.

6. The apparatus of claim 1, wherein each threaded bolt includes a machine screw thread.

7. A door piston to doorjamb interface kit comprising:

a set of threaded bolts;

a set of threaded screws;

a flat, elongated plate having a plurality of threaded holes formed therein, and arranged in at least a first subset of threaded holes and a second subset of threaded holes, with each subset of threaded holes having the same hole pattern; and a bracket including a base and a transverse support member affixed to the base, with the support member defining a pin receiving hole that is spaced from the base and which is configured to receive a pin therethrough for pivotally securing a connecting rod or a housing of a door piston to the support member, and with the base including a set of holes configured in the same pattern as each of the first and second subset of the plurality of threaded holes of the plate wherein:

when the set of holes in the base of the bracket and either the first or second subset of threaded holes in the plate are aligned, one of the threaded bolts inserted through each of the set of holes can threadedly mate with either the first or second subset of threaded holes thereby securing the base to the plate, such that threaded ends of the threaded bolts do not extend outside of the threaded holes when the bracket is secured to the plate; and when the elongated plate is positioned against a door jamb, a threaded screw inserted in non-threading relation through each of the set of holes not receiving a threaded bolt can threadedly mate with said door jamb thereby securing said plate to said door jamb, wherein the support member defines a gap having a pair of aligned pin receiving holes on opposite sides thereof, wherein the end of the connecting rod or the housing defines a hole configured to be aligned with the pair of pin receiving holes when said end is received in the gap, and wherein the pin is configured to be received through the pin receiving holes and the hole in the end of the connecting rod or the housing when said end is received in the gap.

8. The kit of claim 7, wherein the first or second subset of threaded holes is positioned at least one of (i) adjacent an end of the plate and (ii) intermediate the ends of the plate.

9. The kit of claim 7, wherein:

each threaded hole is also configured to pass a threaded wood screw therethrough in non-threading relationship therewith; and when the plate is positioned against a doorjamb, at least one threaded hole can have a wood screw passed in non-threading relationship therethrough whereafter said wood screw can be screwed into the doorjamb thereby securing the plate to the doorjamb.

10. The kit of claim 7, wherein the plate has a rectangular shape.

11. The kit of claim 7, wherein the plurality of threaded holes includes three subsets thereof having the same pattern as the pattern of the set of holes of the base.

12. The kit of claim 7, wherein each threaded bolt includes a machine screw thread.

* * * * *

UNITED STATES PATENT AND TRADEMARK OFFICE

CERTIFICATE OF CORRECTION

PATENT NO. : 7,213,299 B2
APPLICATION NO. : 10/507233
DATED : May 8, 2007
INVENTOR(S) : Grande It is certified that error appears in the above-identified patent and that said Letters Patent is hereby corrected as shown below:

Title Page, insert the following:

-- Related U.S. Application Data
(60) Provisional Application No. 60/363,082, filed on March 11, 2002 --

Signed and Sealed this

Eighteenth Day of September, 2007

JON W. DUDAS
*Director of the United States Patent and Trademark Office*